US009606558B2

(12) United States Patent
Zolnhofer

(10) Patent No.: US 9,606,558 B2
(45) Date of Patent: Mar. 28, 2017

(54) LOWER POWER SWITCHING LINEAR REGULATOR

(71) Applicant: QUALCOMM TECHNOLOGIES INTERNATIONAL, LTD., Cambridge (GB)

(72) Inventor: Jens Bertolt Zolnhofer, Cambridge (GB)

(73) Assignee: QUALCOMM TECHNOLOGIES INTERNATIONAL. LTD., Cambridge (GB)

( * ) Notice: Subject to any disclaimer, the term of this patent is extended or adjusted under 35 U.S.C. 154(b) by 128 days.

(21) Appl. No.: 14/196,457

(22) Filed: Mar. 4, 2014

(65) Prior Publication Data

US 2015/0253792 A1 Sep. 10, 2015

(51) Int. Cl.
*G05F 1/563* (2006.01)
*G05F 1/575* (2006.01)

(52) U.S. Cl.
CPC ..... *G05F 1/575* (2013.01); *G05F 1/563* (2013.01)

(58) Field of Classification Search
CPC ..... H02M 3/158; H02M 2001/0067; H02M 2001/0077; G05F 1/563
USPC ..... 323/265, 268, 271, 270, 284, 350
See application file for complete search history.

(56) References Cited

U.S. PATENT DOCUMENTS 4,920,309 A 4/1990 Szepesi
6,157,178 A 12/2000 Montanari
6,229,289 B1 * 5/2001 Piovaccari ..... H02M 3/1588 323/268
7,084,612 B2 * 8/2006 Zinn ..... H02M 3/158 323/266
7,148,670 B2 * 12/2006 Inn ..... G05F 1/575 323/283
7,315,153 B2 * 1/2008 Tazawa ..... H02M 3/1584 323/272
7,609,039 B2 * 10/2009 Hasegawa ..... H02M 3/1588 323/273
7,688,047 B2 * 3/2010 Sugiyama ..... H02M 1/36 323/268

(Continued)

FOREIGN PATENT DOCUMENTS

EP 1 804 356 A2 7/2007
JP 2006018409 A 1/2006
WO WO 2014/051721 A1 4/2014

OTHER PUBLICATIONS

GB Search Report issued in related GB Application No. 1414014.9, dated Jan. 13, 2015.
GB Search Report Issued in related GB Application No. 1512809.3, dated Feb. 4, 2016, 1 Page.

*Primary Examiner* — Gary L Laxton
*Assistant Examiner* — Kyle J Moody
(74) *Attorney, Agent, or Firm* — Procopio, Cory, Hargreaves & Savitch, LLP

(57) ABSTRACT

A voltage regulator for outputting a voltage having a predetermined relationship with a reference voltage, the voltage regulator includes a driver circuit configured to generate the output voltage, a feedback loop configured to feed back a sensed voltage that is representative of the output voltage to a control unit and the control unit, configured to compare the sensed voltage with the reference voltage and, only if the difference between them exceeds a predetermined threshold, control the driver circuit to adjust the output voltage.

17 Claims, 3 Drawing Sheets

(56) References Cited

U.S. PATENT DOCUMENTS 7,701,181 B2 * 4/2010 Inoue ..... G05F 1/575 323/268
7,759,917 B2 * 7/2010 Ishino ..... H02M 3/1584 323/268
8,120,338 B2 * 2/2012 Kawagishi ..... G05F 1/56 323/269
8,129,969 B1 * 3/2012 Chui ..... H02M 3/157 323/283
8,988,054 B2 * 3/2015 Marty ..... H02M 3/158 323/273
9,188,999 B2 * 11/2015 Lee ..... G05F 1/10
9,343,963 B2 * 5/2016 Cowley ..... G05F 1/46
2006/0097712 A1 5/2006 Wochele
2006/0109039 A1 5/2006 Wu
2007/0018711 A1 1/2007 Miki et al.
2009/0278517 A1 * 11/2009 Kleveland ..... G05F 1/563 323/272
2010/0060078 A1 * 3/2010 Shaw ..... G05F 1/56 307/31
2012/0236674 A1 9/2012 Kluge et al.
2013/0021091 A1 * 1/2013 Robertson ..... G06F 1/3203 327/540
2013/0083951 A1 * 4/2013 Majidzadeh Bafar H03M 1/125 381/320
2013/0169246 A1 * 7/2013 Shao ..... G05F 1/563 323/266
2014/0361758 A1 * 12/2014 Okuma ..... H02M 5/293 323/283
2015/0115920 A1 * 4/2015 Kruiskamp ..... H02M 3/156 323/282
2015/0137778 A1 * 5/2015 Miyazaki ..... H02M 3/156 323/271

* cited by examiner

LOWER POWER SWITCHING LINEAR REGULATOR

FIELD OF THE INVENTION

This invention relates to a regulator for generating a voltage supply.

BACKGROUND

FIG. 1 shows a schematic of a basic linear regulator. The regulator is configured to output a stable output voltage $V_{out}$. The output voltage is sensed via a resistive divider (represented by R1 and R2) and fed back to an error amplifier (represented by A). The error amplifier outputs a voltage to the transistor's gate, thereby controlling the amount of current flowing through the transistor and into resistors R1 and R2. The error amplifier is thus able to regulate the output voltage so that the sense-feedback is the same as a reference voltage $V_{ref}$. The output voltage $V_{out}$ may therefore be a multiple of the reference voltage $V_{ref}$.

A linear regulator such as that shown in FIG. 1 is often used to supply a stable voltage to one or more circuits on a chip. These circuits can often require large load currents and good regulation of the output voltage. These requirements increase the current consumption of the regulator, mainly in the error amplifier. Various techniques are available to reduce current consumption in the regulator when the load-current required is lower. One option is to include a load-current dependent bias-component, a technique known as current-boosting. The requirement for a stable system, however, usually limits the current reduction that can be achieved during low-power operation.

Therefore, there is a need for a new voltage regulator suitable for low power implementations.

SUMMARY

According to a first embodiment, there is provided a voltage regulator for outputting a voltage having a predetermined relationship with a reference voltage, the voltage regulator comprising a driver circuit configured to generate the output voltage, a feedback loop configured to feed back a sensed voltage that is representative of the output voltage to a control unit and the control unit, configured to compare the sensed voltage with the reference voltage and, only if the difference between them exceeds a predetermined threshold, control the driver circuit to adjust the output voltage.

The driver circuit may comprise a current source.

The control unit may be configured to control the current source to act as a switched current source.

The control circuit may be configured to control the driver circuit to adjust the output voltage by activating the current source.

The driver circuit may comprise a transistor configured to act as a current source.

The control circuit may be configured to control the driver circuit by adjusting a voltage at an input of the transistor.

The control circuit may be clocked so that it compares the sensed voltage with the reference voltage only at periodic intervals.

The voltage regulator may comprise a comparator configured to act as the control circuit.

The control unit may be configured to control the driver circuit to adjust the output voltage only if the difference between the sensed voltage and the reference voltage exceeds a hysteresis level of the comparator.

According to a second embodiment, there is provided a voltage regulator for supplying a voltage to one or more circuits, the voltage regulator comprising a first regulator and a second regulator, configured to use less current to output a given voltage than the first regulator but to permit its output voltage to fluctuate within wider limits than the first regulator, and a switching arrangement configured to, in dependence on an operating mode of the one or more circuits, connect either the first regulator or the second regulator to supply them with a voltage.

The switching arrangement may be configured to connect the first regulator to supply the one or more circuits if they are operating in a normal mode.

The switching arrangement may be configured to connect the second regulator to supply the one or more circuits if they are operating in a power-saving mode.

Both the first and second regulators may comprise a current source.

At least one of the first and second regulators may comprise a transistor configured to act as the current source.

The first regulator may comprise a larger transistor than the second regulator.

The current source of the first regulator may be capable of supplying a higher current than the current source of the second regulator.

The current source of the second regulator may be configured to act as a switched current source.

The second regulator may comprise a control circuit configured to permit the second regulator's output voltage to fluctuate only within predefined limits.

The control circuit may be configured to activate the current source responsive to the output voltage exceeding those predefined limits.

The control circuit may be clocked so that the control circuit samples the output voltage of the second regulator only at periodic intervals.

The second regulator may comprise a comparator configured to act as the control circuit.

The first regulator may comprise a control circuit configured to keep the first regulator's output voltage substantially constant.

The control circuit may be configured to constantly monitor the output voltage of the first regulator.

The first regulator may comprise an error amplifier configured to act as the control circuit.

According to a third embodiment, there is provided a method for supplying a voltage to one or more circuits, the method comprising, when the one or more circuits are operating in a normal mode, connecting a first voltage regulator to supply the voltage, and, when the one or more circuits are operating in a power-saving mode, connecting a second voltage regulator to supply the voltage, said second voltage regulator being configured to use less current to output a given voltage than the first voltage regulator but to permit its output voltage to fluctuate within wider limits than the first voltage regulator.

BRIEF DESCRIPTION OF THE DRAWING

The present invention will now be described by way of example with reference to the accompanying drawings. In the drawings.

DETAILED DESCRIPTION

Figure 2:
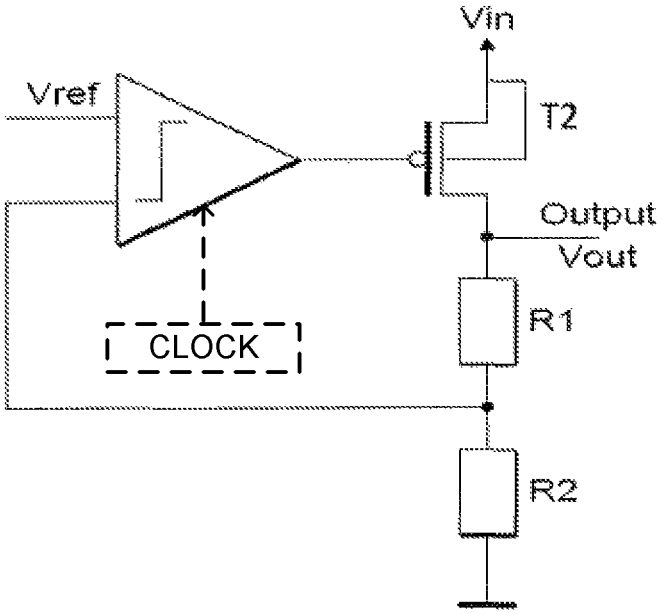
FIG. 2 shows an example of a voltage regulator.

An example of a voltage regulator is shown in FIG. 2. The regulator is suitable for outputting a voltage having a predetermined (either fixed or programmable) relationship with a reference voltage. For example, the output voltage may be a multiple of the reference voltage. In some examples the multiple may be one.

The circuit comprises a driver circuit configured to generate the output voltage. In this example the driver circuit is implemented by comparator C and pass-device T2, which is a transistor acting as pass-transistor. The circuit also includes a feedback loop configured to feed back a sensed voltage from the output via resistors R1 and R2. This voltage is representative of the output voltage. It changes proportionally as the output voltage changes. In this example, since the circuit is configured to output a voltage that is a multiple of the reference voltage, the sensed voltage is a fraction of the output voltage and is obtained via the potential divider formed by R1 and R2.

The sensed voltage is fed back to a control unit, which has been implemented as a comparator (C) in FIG. 2. The control unit is configured to compare the sensed voltage with the reference voltage $V_{ref}$. If the sensed voltage drops below the reference voltage by more than a predetermined threshold, the control unit controls the driver circuit to adjust the output voltage so that the sensed voltage increases above the threshold again. For example, in the arrangement of FIG. 2, the control unit adjusts the gate voltage of transistor T2. If the difference between the two voltages does not exceed the predetermined threshold, the control unit does not change its control of the driver circuit. Active control of the output voltage by the control unit is thus intermittent rather than continuous. For example, in the arrangement of FIG. 2, the control unit only outputs a voltage that will trigger the transistor to become conducting and boost the output voltage when the difference between the reference voltage and the sensed voltage exceeds the threshold. Otherwise, the gate voltage of T2 remains unchanged. T2 effectively acts a switched current-source. Typically, in the simplest implementation of such a circuit, the current source is either fully on or fully off and, depending on which of the two it is, the output voltage either goes up or down. Switching between fully on and fully off is the simplest implementation of this circuit; however, the voltage regulator is not limited to these two states. In some implementations the current source may have a number of different "on" states, each generating a different amount of current, which it can be switched between to adjust the output voltage. The negative feedback through the comparator switches the current source into the opposite state once the output has passed the threshold. So the current source keeps switching between its two different states.

The value of the source current through T2 depends on its dimensions, as well as the input and output voltages of the regulator. The frequency with which T2 is switched depends on its dimensions, the input and output voltages of the regulator, the load-current, which is taken from the output, and the predetermined switching threshold, which is the difference between the inputs of the comparator that has to be exceeded before it is triggered (this is also known as hysteresis of the comparator).

Figure 1:
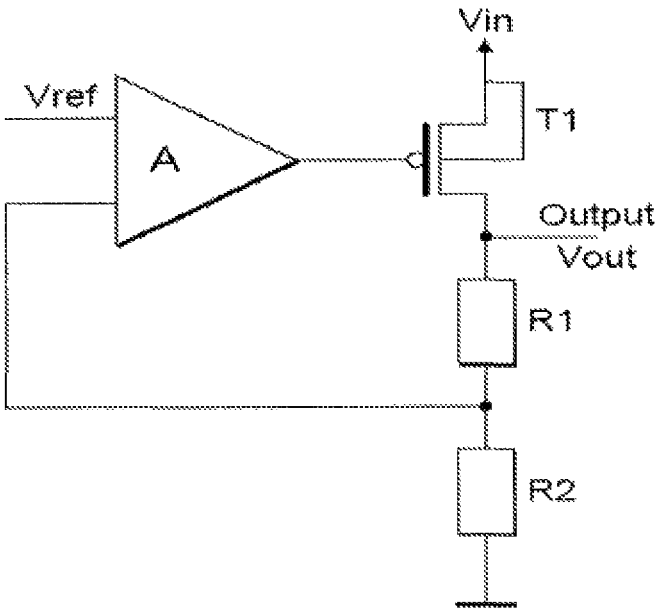
FIG. 1 shows a conventional voltage regulator.

There are a number of differences between the regulator in FIG. 2 and the linear regulator in FIG. 1. First, the error amplifier required for continuous-time operation of the linear regulator control-loop has been replaced by a comparator. Second, device T1, which often needs to be large to be able to deliver large load-currents, has been replaced by T2, which is chosen to be significantly smaller than T1. The arrangement of FIG. 2 is inherently stable since it is time-discreet with negative feedback. Although the output oscillates between a minimum and maximum value, there is no possibility that the output will 'run off' and get stuck at the positive or negative rail.

The switched regulator can be designed with much lower quiescent current consumption than the continuous-time linear regulator. The pass-device T1 in the 'continuous-time' linear regulator should always be biased in its saturation region, and it needs to be dimensioned to be able to pass the maximum required current. In the switched version, the pass-device T2 will typically be turned hard on, which means it can provide the same maximum current whilst being smaller size. With a continuous-time linear regulator, parasitic poles have to be kept beyond the bandwidth of the regulator (usually at a minimum of 10× the bandwidth) to ensure stability of the system. This costs current, especially with a larger pass-device. This can be alleviated by using a separate, smaller pass-device in low-power mode; however, the switched regulator should still consume less current overall.

The circuit in FIG. 2 exploits the hysteresis of the comparator to control the current source to act in a switched manner. It is this hysteresis that determines when the comparator will output a "one" as opposed to a "zero". It sets the threshold that triggers control of T2. The threshold for the circuit can therefore be set by designing the comparator to have the appropriate level of hysteresis. The same idea can also be implemented with a clocked, rather than a free-running comparator. This would enable control of the switching frequency, but may increase the ripple on the output and adds the requirement of a clock. Other implementations may switch the pass-switch between a 'high' and a 'low' level that are neither fully on nor fully off. In an implementation such as this the 'low' level could, for example, be set to a known minimum level of load-current. This might be suitable, for example, for cases in which there will always exist a minimum load current. The amount of switching could be reduced in an implementation such as this; however, the complexity of the circuit would be increased.

In many implementations, the regulator shown in FIG. 2 may output to a capacitor (not shown) for storing charge output by the circuit and smoothing the output voltage.

Figure 3:
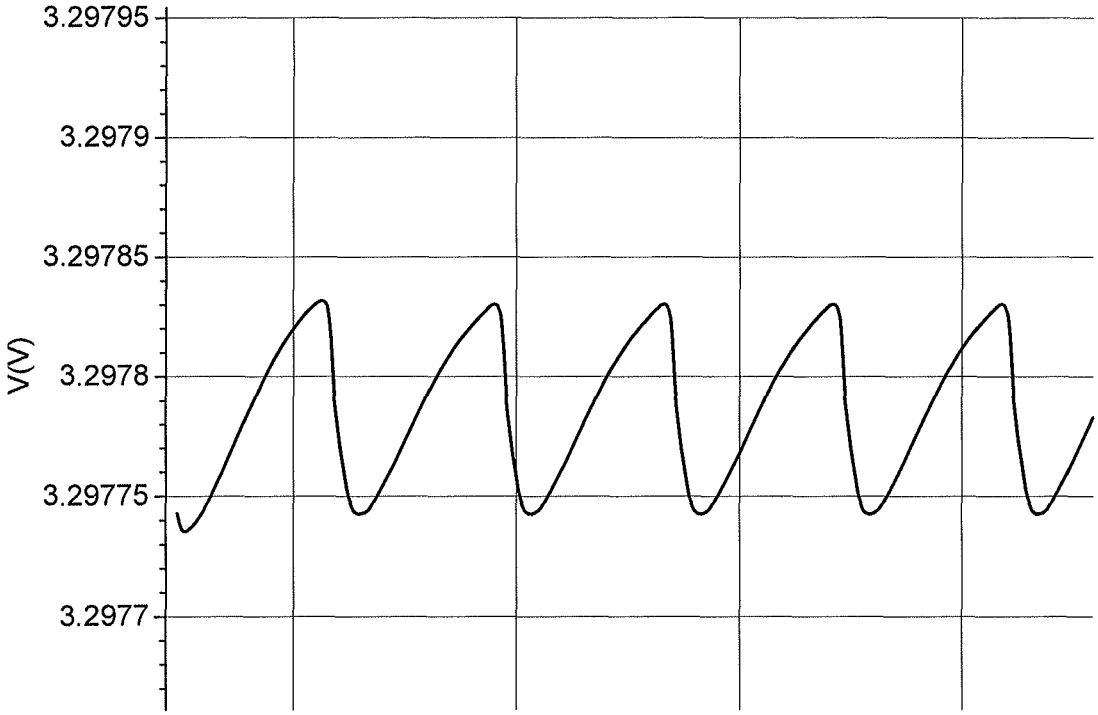
FIG. 3 shows an example of a voltage output by the voltage regulator.

A typical waveform showing what the output voltage may look like is shown in FIG. 3. It has the form of a smoothed saw-tooth wave. When the reference voltage is greater than the sensed voltage by a predetermined amount, the control unit activates the current source so that the output voltage increases (as can be seen in FIG. 3). In the example of FIG. 2, the current source is a PMOS transistor that is conducting with 0V at its gate. The output voltage increases as current flows through the transistor, causing the output capacitor to charge up. As the output voltage increases, the sensed voltage also increases until the difference between the sensed voltage and the reference voltage no longer exceeds the threshold. The control unit then deactivates or limits the current source so that the output voltage decreases (as can be seen in FIG. 3) as current flows into the load and through resistors R1 and R2. In the example of FIG. 2, the comparator switches its output to the alternative logic level, so that the voltage at the gate of the PMOS transistor is close or equal to Vin. This voltage at the gate of the PMOS transistor reduces the current flowing from drain to source to near zero. In effect the regulator operates in a repetitive cycle of switching on the current source to boost the output voltage and then allowing the output voltage to drop by either switching off or limiting the current source.

FIG. 3 shows how for a constant load-current, the switched current source charges the output up when switched on, until the sensed voltage crosses the comparator threshold, whereupon the switched current source is switched off and the output discharges under its load-current until it crosses the comparator threshold again. The example shown in FIG. 3 makes use of the natural hysteresis in the comparator. No particular hysteresis was designed into the comparator, so the ripple is quite small and the frequency quite high.

The voltage output by the regulator described herein will tend to fluctuate more than and show limited load-regulation and load step response compared to a conventional regulator. For example, the output voltage of this circuit with a constant load-current may fluctuate within several mV. The fluctuation may be tailored to the particular application, as some applications are more tolerant of ripple than others. The fluctuation could, for example, be up to 10 mV or more, depending on implementation and load-current. Preferably the fluctuation is between 1 mV and 5 mV. This compares with a typical fluctuation of near zero in a conventional continuous-time regulator. For example, fluctuations in a conventional continuous-time regulator are generally just due to noise (if neither load, nor supply, nor temperature change) and are typically less than 1 μV. This may be acceptable when a chip is operating in a low-power state, however. Frequently the load-current may be very low in this scenario, and the output voltage need only be roughly maintained in order to keep the supplied circuit in its current state, without many operations actually being performed. This may particularly apply to digital circuitry, although some analogue circuits may also be tolerant of an unclean supply voltage in a low-power state.

Figure 4:
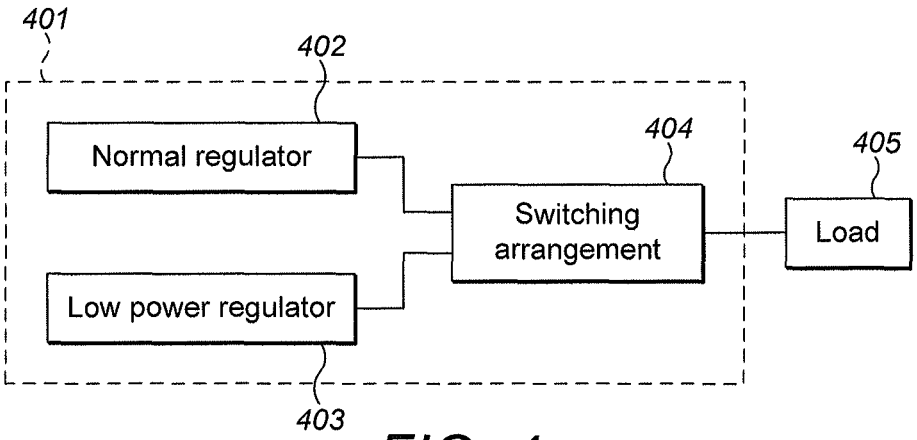
FIG. 4 shows an example of two voltage regulators capable of supplying a voltage to one or more circuits on a chip.

In one example, one or more circuits on a chip may be configured so that they can be supplied either by a low-current regulator, such as that described herein, or a conventional regulator, such as that shown in FIG. 1. In effect a voltage regulator may comprise two regulators that are independently capable of generating a supply voltage for one or more circuits on a chip. An example is shown in FIG. 4. FIG. 4 shows the two regulators separately for the purposes of illustration. In practice, however, the two regulators are more likely to be implemented by one regulator having two different modes of operation. Another way of viewing this is that there are two regulators, but they share most of their circuitry.

In FIG. 4 the voltage regulator 401 is represented by the dotted line. It comprises a normal regulator 402 and a low power regulator 403. The normal regulator uses more current than the low power regulator but it generates a cleaner supply voltage. The low power regulator outputs a voltage that fluctuates more, but this may be acceptable to circuits that need a supply voltage during a low power mode of operation but which do not require that voltage to be particularly clean. The decision whether a relatively unclean supply voltage is a sensible proposition for a particular circuit should be taken on a case-by-case basis. The voltage arrangement includes a switching arrangement 404 for connecting either the normal regulator or the low power regulator to a load 405, depending on an operating mode of the load. In practice, it is likely that part of the circuitry will be shared between 402 and 403 and the switching arrangement 404 will be implemented by two pass-devices one of which will be driven by 402, the other one of which will be driven by 403. However, practical implementations are not limited to this solution and other implementations are also possible.

Figure 5:
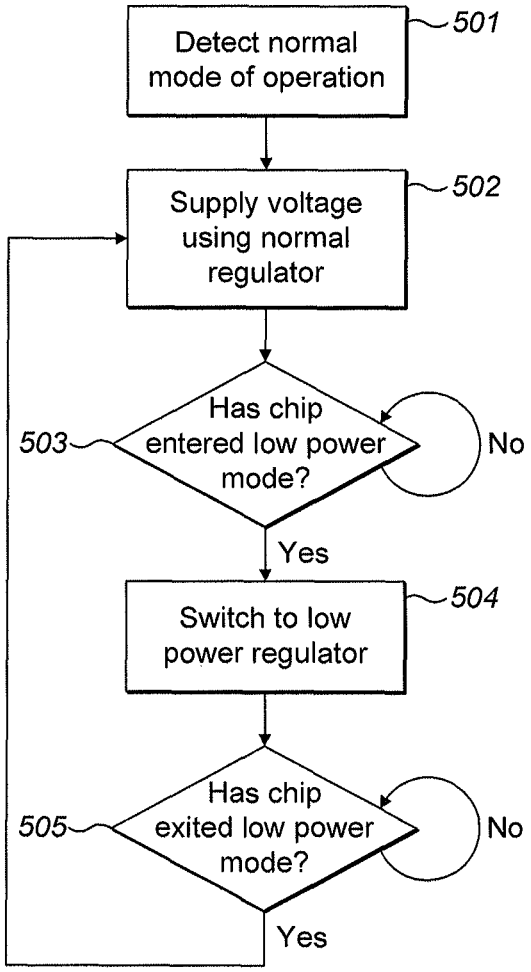
FIG. 5 shows an example of a method for supplying a voltage to one or more circuits on a chip.

An example of a method for switching between two regulators is shown in FIG. 5. The method comprises detecting that the circuit(s) to which the voltage regulator supplies a voltage is operating in a normal (i.e. non-low power) mode (step 501). The normal regulator is thus selected to provide the supply voltage (step 502). The method then comprises checking whether the circuit(s) has entered a low power mode (step 503). In many cases this will coincide with the chip as a whole entering a low power mode. If so, the normal regulator is disconnected from supplying the voltage in preference for the low power regulator (step 504). This situation continues until the circuit(s) exits low power mode (step 505), whereupon the normal regulator resumes supplying the voltage.

The regulator described herein may offer considerable power saving advantages over a conventional regulator. Typically a conventional regulator may use at least 3-5 uA whereas the circuit described herein may be capable of running on a quiescent current of only a few hundred nA. This current saving will typically outweigh the drawback of needing a small amount of additional circuitry, particularly for battery-operated devices that spend a lot of time in a sleep or low power mode.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

The invention claimed is:

1. A voltage regulator for supplying a voltage to one or more circuits, the voltage regulator comprising:

a first regulator having a first pass transistor and an error amplifier configured to provide continuous control of the first pass transistor, the first regulator configured as a linear regulator having a continuous time linear regulator control loop; and a second regulator configured as a time-discrete negative feedback voltage regulator, the second regulator having a control circuit having a clocked comparator directly coupled to a gate of a second pass transistor wherein a clock frequency determines a switching frequency of the second pass transistor, the second regulator being further configured to use less current to output the voltage than the first regulator but to permit the voltage supplied to the one or more circuits by the second regulator to fluctuate more than the voltage supplied by the first regulator; and a switching arrangement configured to, in dependence on an operating mode of the one or more circuits, connect either the first regulator or the second regulator to supply the voltage to the one or more circuits.

2. The voltage regulator as claimed in claim 1, wherein the switching arrangement is configured to connect the first regulator to supply the voltage to the one or more circuits if the one or more circuits are operating in a normal mode.

3. The voltage regulator as claimed in claim 1, wherein the switching arrangement is configured to connect the second regulator to supply the second output voltage to the one or more circuits if the one or more circuits are operating in a power-saving mode.

4. The voltage regulator as claimed in claim 1, in which both the first regulator and the second regulator comprise a current source.

5. The voltage regulator as claimed in claim 4, wherein at least one of the first regulator and the second regulator further comprise a transistor configured to act as the current source.

6. The voltage regulator as claimed in claim 5, wherein the first regulator comprises a larger transistor than the second regulator.

7. The voltage regulator as claimed in claim 4, wherein the current source of the first regulator is capable of supplying a higher current than the current source of the second regulator.

8. The voltage regulator as claimed in claim 4, wherein the current source of the second regulator is configured to act as a switched current source.

9. The voltage regulator as claimed in claim 1, wherein the control circuit of the second regulator is configured to permit the voltage to fluctuate only within predefined limits based on a hysteresis of the clocked comparator.

10. The voltage regulator as claimed in claim 1, wherein the control circuit is configured to activate a current source of the first regulator responsive to the voltage supplied to the one or more circuits by the second regulator exceeding predefined limits.

11. The voltage regulator as claimed in claim 1, wherein the control circuit is clocked so that the control circuit samples the voltage supplied to the one or more circuits by the second regulator only at periodic intervals.

12. The voltage regulator as claimed in claim 1, wherein the error amplifier is configured to keep the voltage supplied to the one or more circuits by the first regulator at a substantially constant value.

13. The voltage regulator as claimed in claim 12, wherein the error amplifier is configured to constantly monitor the output voltage supplied to the one or more circuits by the first regulator.

14. The voltage regulator as claimed in claim 1, wherein the switching arrangement further comprises a first pass-device driven by the first regulator and a second pass-device driven by the second regulator, the switching arrangement configured to connect one of the first regulator and the second regulator to the one or more circuits.

15. The voltage regulator as claimed in claim 1, wherein the clocked comparator is operable to compare a sensed voltage with a reference voltage, where the sensed voltage is based on the voltage supplied to the one or more circuits.

16. The voltage regulator as claimed in claim 1, wherein the voltage supplied to the one or more circuits comprises a regulated output voltage.

17. A method for supplying a voltage to one or more circuits, the method comprising:

switching between supplying the voltage to the one or more circuits with a first voltage regulator having a first pass transistor and an error amplifier configured to provide continuous control of the first pass transistor, the first regulator configured as a linear regulator having a continuous time linear regulator control loop, and a second voltage regulator configured as a time-discrete negative feedback voltage regulator, the second regulator having a control circuit having a clocked comparator directly coupled to a gate of a second pass transistor wherein a clock frequency determines a switching frequency of the second pass transistor, the switching comprising:

when the one or more circuits are operating in a normal mode, connecting the first voltage regulator to the one or more circuits to supply the voltage; and when the one or more circuits are operating in a power-saving mode, connecting the second voltage regulator to the one or more circuits to supply the voltage;

said second voltage regulator being configured to use less current to output the voltage than the first voltage regulator but to permit the voltage supplied to the one or more circuits to fluctuate more than the first voltage regulator.

* * * * *